US007764294B2

(12) United States Patent
Lee

(10) Patent No.: US 7,764,294 B2
(45) Date of Patent: Jul. 27, 2010

(54) APPARATUS FOR DRIVING A LIQUID CRYSTAL DISPLAY BY CONVERTING INPUT IMAGE DATA INTO A PLURALITY OF IMAGE DATA AND USING TWO-FRAME INVERSION

(75) Inventor: Seung-Woo Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1070 days.

(21) Appl. No.: 11/342,132

(22) Filed: Jan. 28, 2006

(65) Prior Publication Data

US 2006/0176322 A1 Aug. 10, 2006

(30) Foreign Application Priority Data

Feb. 4, 2005 (KR) ..... 10-2005-0010607

(51) Int. Cl.
*G09G 5/10* (2006.01)

(52) U.S. Cl. ..... 345/690

(58) Field of Classification Search ..... 345/87–89, 345/96–100, 589, 690–694, 204, 209
See application file for complete search history.

(56) References Cited

U.S. PATENT DOCUMENTS

| | | | | |
|---|---|---|---|---|
| 6,040,826 | A * | 3/2000 | Furukawa | 345/534 |
| 2002/0063666 | A1 * | 5/2002 | Kang et al. | 345/87 |
| 2002/0149598 | A1 * | 10/2002 | Greier et al. | 345/589 |
| 2003/0214473 | A1 * | 11/2003 | Lee | 345/87 |
| 2005/0200585 | A1 * | 9/2005 | Igarashi et al. | 345/93 |

* cited by examiner

*Primary Examiner*—Sumati Lefkowitz
*Assistant Examiner*—Rodney Amadiz
(74) *Attorney, Agent, or Firm*—F. Chau & Associates, LLC

(57) ABSTRACT

An apparatus for driving a display device having a plurality of pixels includes a signal controller for selecting one data from a plurality of image data based on input image data, converting the selected data into output image data and outputting the output image data, and a data driver for converting the output image data from the signal controller into data voltages and applying the data voltages to the pixels. The mean value of front gammas of the first and second image data corresponds to the front gamma with respect to the input image data.

16 Claims, 11 Drawing Sheets

APPARATUS FOR DRIVING A LIQUID CRYSTAL DISPLAY BY CONVERTING INPUT IMAGE DATA INTO A PLURALITY OF IMAGE DATA AND USING TWO-FRAME INVERSION

CROSS-REFERENCE TO RELATED APPLICATIONS

This application claims priority to Korean Patent Application No. 2005-0010607, filed on Feb. 4, 2005, the disclosure of which is herein incorporated by reference in its entirety.

BACKGROUND OF THE INVENTION

1. Technical Field

The present invention relates to an apparatus for driving a display device such as a liquid crystal display.

2. Description of the Related Art

A liquid crystal display (LCD) includes two panels provided with field-generating electrodes, such as pixel and common electrodes, and a liquid crystal layer interposed therebetween. An LCD displays images by applying voltages to the field-generating electrodes to generate an electric field in the liquid crystal layer which aligns the liquid crystal molecules of the liquid crystal layer to control the polarization of incident light, thereby displaying images. An LCD realizes gray scale by adjusting the voltages between the pixel electrodes and the common electrode. Generally, the gray scale ranges from the first gray representing the darkest state to the sixty-fourth gray representing the brightest state.

A vertically-aligned (VA) mode LCD, in which longitudinal axes of liquid crystal molecules are aligned perpendicular to the two panels in the absence of an electric field, can produce a relatively high contrast ratio and a relatively wide viewing angle. The contrast ratio can be defined as the luminance of the sixty-fourth gray divided by that of the first gray.

When an electric field is applied, the liquid crystal molecules are tilted with respect to an axis normal to the panels at angles dependent on the strength of the electric field, so that polarization of light passing through the liquid crystal layer can be changed. The larger the tilt angle of the liquid crystal molecules, the larger the amount of change in polarization. The wide viewing angle of the VA mode LCD may be realized by openings (cutouts) or protrusions on the field-generating electrodes. As the tilt angle of the liquid crystal molecules is determined by the openings or the protrusions, the tilt angle of the liquid crystal molecules can be increased, thereby widening the viewing angle.

However, the contrast ratio of a VA mode LCD may be poor when viewed from its lateral sides, as compared to when viewed from the front of the display. For example, in the case of a patterned vertically aligned (PVA) mode LCD having the opening in the field-generating electrodes, the luminance is enhanced toward the display's lateral sides. In the worse case, the luminance difference between high grays vanishes such that the image can not be perceived.

In one method to improve contrast ratio, a pixel is divided into two sub-pixels, and the two sub-pixels are capacitance-combined with each other. Voltage is directly applied to one sub-pixel, and a voltage drop is caused at the other sub-pixel due to the capacitance combination so that the two sub-pixels differ in voltage from each other, thereby differentiating the light transmittance thereof.

However, it is difficult to precisely control the light transmittance of the two sub-pixels. For example, as the light transmittance is differentiated for respective colors, the proper voltage distribution cannot be separately made for the respective colors. Furthermore, the aperture ratio may be deteriorated due to the addition of a conductor for the capacitance combination and the pixel division into the two sub-pixels, and the light transmittance may be decreased as a voltage drop is caused due to the capacitance combination.

SUMMARY OF THE INVENTION

According to one aspect of the present invention, an apparatus for driving a display device having a plurality of pixels includes a signal controller for selecting one data from a plurality of image data corresponding to the input image data and converting the selected data into output image data, and a data driver for converting the output image data from the signal controller into data voltages and applying the data voltages to the pixels. The mean value of front gammas of the plurality of image data corresponds to the front gamma with respect to the input image data.

The plurality of image data may be alternately applied to the respective pixels.

The polarities of the data voltages applied to the plurality of pixels may be based on a (1×2)-dot inversion. The polarities of the data voltages applied to the plurality of pixels may be based on a two-frame inversion.

The plurality of image data may be alternately applied to the respective pixel rows.

The plurality of image data may be alternately applied to predetermined pixels per frame.

The polarities of the data voltages applied to the plurality of pixels may be based on a (1×1)-dot inversion.

The polarities of the data voltages applied to the plurality of pixels may be based on a two-frame inversion.

The plurality of image data may include first and second image data, and the first image data have gray values higher than the gray values of the input image data, and the second image data have gray values lower than the gray values of the input image data.

The signal controller may include a first data storage member for storing the first image data and a second data storage member for storing the second image data, and wherein the signal controller converts the first or second image data from the first or second data storage member, respectively, into output image data based on the input image data and outputs the output image data.

The signal controller may include a DCC unit for comparing the output image data with the output image data of the previous frame and for correcting the output image data into last output image data to output the corrected data as data voltages, and a frame memory for storing the previous output image data.

The signal controller may further include a color correction unit for correcting the input image data such that the color temperature thereof has a predetermined characteristic depending upon the increase or decrease in the gray level.

According to another aspect of the present invention, an apparatus for driving a display device having a plurality of pixels includes a signal controller for converting input image data into output image data and outputting the output image data; a gray voltage generator having a first gray voltage generating member for generating a plurality of first gray voltages and a second gray voltage generating member for generating a plurality of second gray voltages; and a data driver for selecting one of the first or second gray voltage generating members based on the output image data from the signal controller, and for converting the respective gray voltages into data voltages and applying the converted voltages to the pixels. The mean value of front gammas of the image data corresponding to the first and second gray voltages corresponds to the front gamma with respect to the input image data.

The image data corresponding to the first gray voltages have a higher gray level than the gray level of the input image data, and the image data corresponding to the second gray voltages have a lower gray level than the gray level of the input image data.

The first and second gray voltages may be alternately applied to the respective pixel rows. The first and second gray voltages may be alternately applied to predetermined pixels per frame.

The polarities of the gray voltages applied to the plurality of pixels may be based on a (1×1)-dot inversion. The polarities of the gray voltages applied to the plurality of pixels may be based on a two-frame inversion. The input image data may have a frequency of about 120 Hz.

BRIEF DESCRIPTION OF THE DRAWINGS

The present invention will become more apparent to those of ordinary skill in the art when descriptions of exemplary embodiments thereof are read with reference to the accompanying drawings, of which.

DETAILED DESCRIPTION OF PREFERRED EMBODIMENTS

Figure 1:
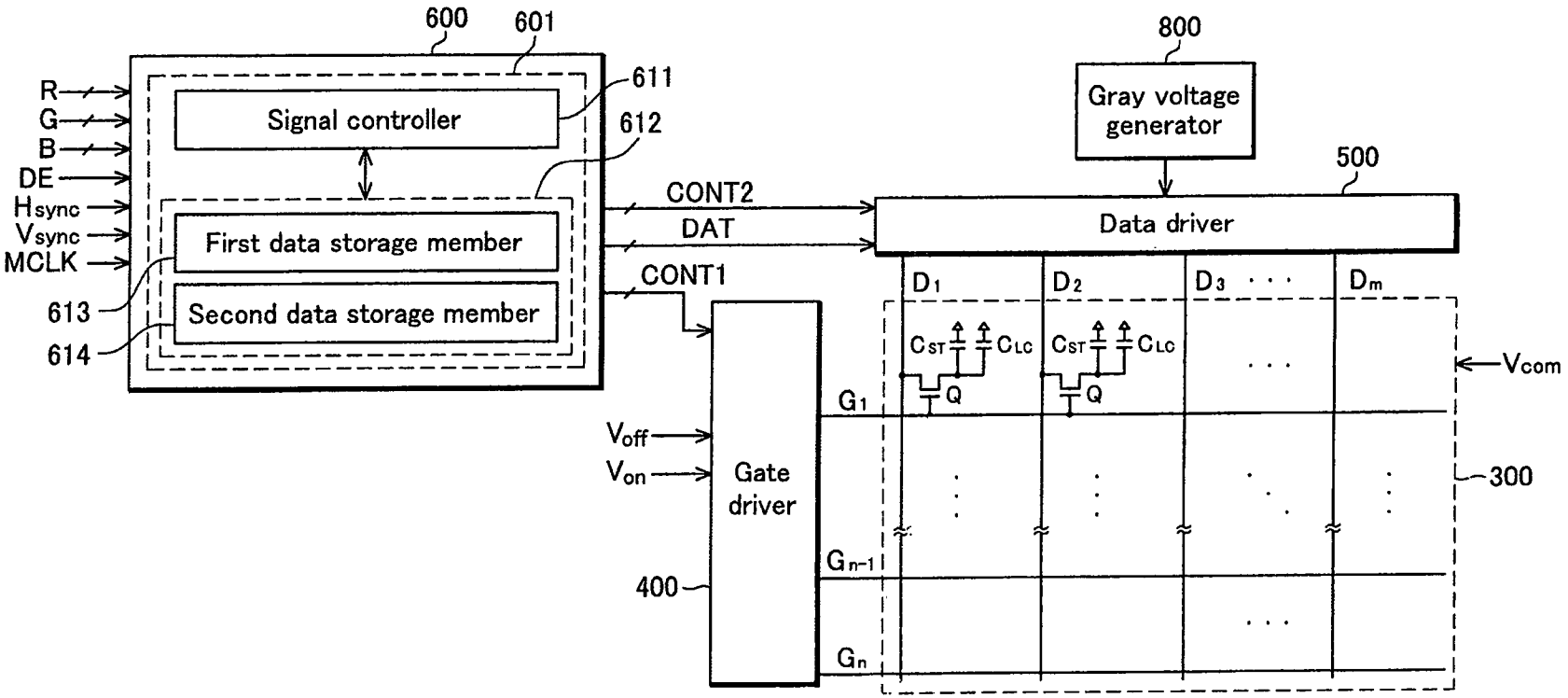
FIG. 1 is a block diagram of an LCD according to an exemplary embodiment of the present invention.

Hereinafter the exemplary embodiments of the present invention will be described in detail with reference to the accompanying drawings.

In the drawings, the size and relative sizes of layers, films, and regions may be exaggerated for clarity. Like reference numerals refer to similar or identical elements throughout the description of the figures. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Figure 2:
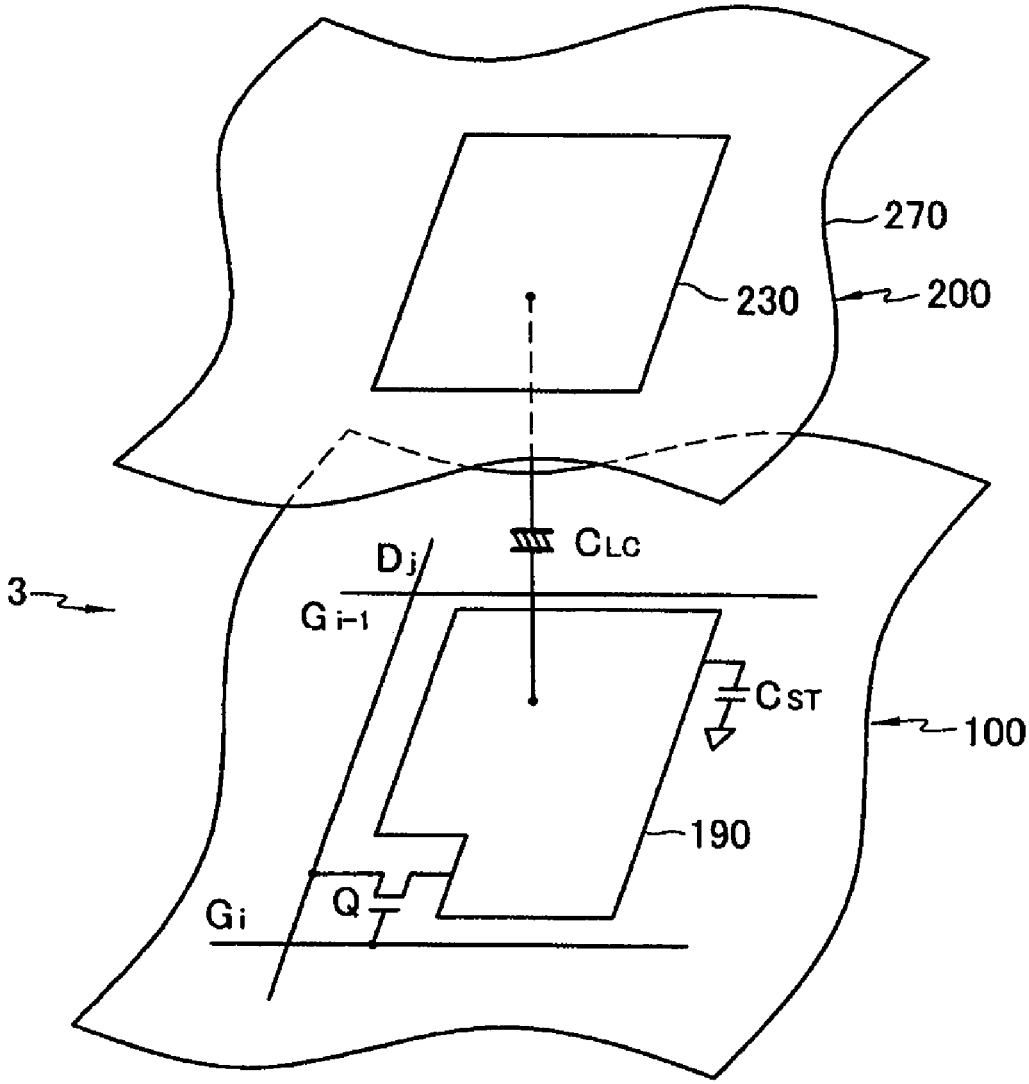
FIG. 2 is a circuit diagram of a pixel of an LCD according to an exemplary embodiment of the present invention.

FIG. 1 is a block diagram of an LCD according to an exemplary embodiment of the present invention. FIG. 2 is a circuit diagram of a pixel of an LCD according to an exemplary embodiment of the present invention.

Referring to FIG. 1, an LCD includes a liquid crystal panel assembly 300, gate and data drivers 400 and 500 connected to the liquid crystal panel assembly 300, a gray voltage generator 800 connected to the data driver 500, and a signal controller 600 for controlling them.

The liquid crystal panel assembly 300 includes a plurality of display signal lines G1-Gn and D1-Dm, and a plurality of pixels connected to those lines and arranged generally in matrix form. The liquid crystal panel assembly 300 includes lower and upper panels 100 and 200, and a liquid crystal layer 3 interposed between the panels.

The display signal lines G1-Gn and D1-Dm include a plurality of gate lines G1-Gn for transmitting gate signals (also called "scanning signals") and data lines D1-Dm for transmitting data signals. The gate lines G1-Gn extend generally in the direction of pixel rows and are parallel or approximately parallel to each other. The data lines D1-Dm extend generally in the direction of pixel columns and are parallel or approximately parallel to each other.

The respective pixels have a switching element Q connected to the respective gate lines G1-Gn and the respective data lines D1-Dm. A liquid crystal capacitor $C_{LC}$ is connected to the switching element Q. An optional storage capacitor $C_{ST}$ may be connected to the switching element Q.

The switching elements Q at the respective pixels may be formed with thin film transistors provided at the lower panel 100. For example, the thin film transistors comprise a control terminal connected to one of the gate lines G1-Gn, an input terminal connected to one of the data lines D1-Dm, and an output terminal connected to the liquid crystal capacitor $C_{LC}$ and the storage capacitor $C_{ST}$.

The liquid crystal capacitor $C_{LC}$ includes a pixel electrode 190 of the lower panel 100 and a common electrode 270 of the upper panel 200, and the liquid crystal layer 3 interdisposed between the two electrodes 190 and 270 as a dielectric. The pixel electrode 190 is connected to the switching element Q. The common electrode 270 may be formed on the entire surface of the upper panel 200 to receive a common voltage Vcom. Although not shown as such in FIG. 2, the common electrode 270 may be provided on the lower panel 100, and at least one of the pixel electrode 190 or the common electrode 270 may be formed in the shape of a line or a bar.

The storage capacitor $C_{ST}$ subsidiary to the liquid crystal capacitor $C_{LC}$ may be formed by overlapping the pixel electrode 190 with a separate signal line (not shown) provided on the lower panel 100 while interposing an insulator therebetween. A predetermined voltage such as the common voltage Vcom is applied to the separate signal line. Alternatively, the storage capacitor $C_{ST}$ may be formed by overlapping the pixel electrode 190 with the just overlying previous gate line while interposing an insulator therebetween.

The colors red, green, and blue are termed the primary additive colors (hereinafter, referred to as "primary colors"). To display colors, the respective pixels produce one of the primary colors (spatial division), or produce the primary colors in temporal order (time division) such that the desired colors can be displayed by the spatial and temporal sum of the primary colors.

FIG. 2 shows an example of the time division where each pixel has a color filter 230 producing one of the primary colors at the region of the upper panel 200. Although not shown as such in FIG. 2, the color filter 230 may be formed above or below the pixel electrode 190 of the lower panel 100.

A polarizer (not shown) may be connected to at least one of the two panels 100 and 200 of the liquid crystal panel assembly 300.

The gray voltage generator 800 generates a plurality of gray voltages related to the light transmittance of the pixels. For example, the gray voltage generator 800 generates a first set of gray voltages having a positive polarity with respect to the common voltage Vcom, and a second set of gray voltages having a negative polarity with respect thereto.

The gate driver 400 is connected to the gate lines G1-Gn of the liquid crystal panel assembly 300 to apply gate signals to the gate lines G1-Gn based on a combination of a gate on voltage Von and a gate off voltage Voff. The gate driver 400 may be formed with a plurality of integrated circuits.

The data driver 500 is connected to the data lines D1-Dm of the liquid crystal panel assembly 300 to select gray voltages from the gray voltage generator 800 and apply the selected gray voltages to the pixels as data voltages. The data driver 500 may be formed with a plurality of integrated circuits.

The gate driver 400 or the data driver 500 may be directly mounted on the liquid crystal panel assembly 300 in the form of a plurality of driving integrated circuit chips, or may be attached to the liquid crystal panel assembly 300 in the form of a tape carrier package TCP and may be mounted on a flexible printed circuit film (not shown). Alternatively, the gate driver 400 or the data driver 500 may be integrated on the liquid crystal panel assembly 300 together with the signals lines G1-Gn and D1-Dm and thin film transistor switching elements Q.

The signal controller 600 includes an image data correction unit 610, and controls the operation of the gate driver 400 and the data driver 500.

Hereinafter, the operation of the LCD, according to an exemplary embodiment of the present invention, will be explained in detail.

The signal controller 600 receives input image signals R, G, and B and input control signals for controlling those image signals from an external graphics controller (not shown). The input control signals include vertical synchronization signals Vsync, horizontal synchronization signals Hsync, main clock signals MCLK, and data enable signals DE. The signal controller 600 processes the input image signals R, G, and B based on the input image signals R, G, and B and the input control signals depending upon the operation conditions of the liquid crystal panel assembly 300. The signal controller 600 generates gate control signals CONT1 and data control signals CONT2, and transmits the gate control signals CONT1 to the gate driver 400 and transmits the data control signal CONT2 and the processed image data DAT to the data driver 500.

The data processing of the signal controller 600 involves the outputting of output image data having different gray values as the image data DAT for the neighboring pixels, based on the input gray values of the input image data R, G, and B having a predetermined frequency. The operation of the signal controller 600 will be explained later in this disclosure.

The gate control signals CONT1 include scanning start signals STV for instructing to start scanning, and at least one clock signal for controlling the output time of the gate on voltage Von. The gate control signals CONT1 may further include output enable signals OE for defining the duration of the gate on voltage Von.

The data control signals CONT2 include horizontal synchronization start signals STH for informing of the data transmission to the pixels of one pixel row, load signals LOAD for applying the relevant data voltages to the data lines D1-Dm, and data clock signals HCLK. The data control signals CONT2 further include reverse signals RVS for inverting the polarity of the data voltage with respect to the common voltage Vcom (hereinafter, referred to as the polarity 6*f* the data voltage).

The data driver 500 receives image data DAT related to the pixels of one pixel row in accordance with the data control signals CONT2 from the signal controller 600, and selects the gray voltages corresponding to the respective image data DAT from among the gray voltages generated by the gray voltage generator 800. The data driver 500 converts the image data DAT into analog data voltages corresponding thereto and applies them to the respective data lines D1-Dm.

The gate driver 400 sequentially applies the gate on voltage Von to the gate lines G1-Gn in accordance with the gate control signals CONT1 from the signal controller 600, and the switching elements Q connected to the gate lines G1-Gn turn on so that the data voltages applied to the data lines D1-Dm are applied to the respective pixels through the turned-on switching elements Q.

The difference between the data voltage applied to the pixel and the common voltage Vcom is represented by the charge voltage of the liquid crystal capacitor $C_{LC}$, that is, by the pixel voltage. The liquid crystal molecules are re-oriented depending upon the dimension of the pixel voltage, and the light passing through the liquid crystal layer 3 is varied in polarization. The polarization variation is represented by the variation in light transmittance due to polarizers (not shown) attached to the panels 100 and 200, and the pixel luminance is determined.

The data driver 500 and the gate driver 400 repeat the same operation while taking one horizontal cycle or 1H (a cycle of the horizontal synchronization signal Hsync and the gate clock CPV) as a unit. In this way, the gate on voltage Von is sequentially applied to all the gate lines G1-Gn during one frame, thereby applying the data voltages to all the pixels. When one frame terminates, the next frame starts, and the reverse signals RVS applied to the data driver 500 are controlled such that the polarity of the data voltages applied to the respective pixels is inverted for predetermined frames (the frame inversion). At this point, the polarity of the data voltage applied to one data line may be inverted depending upon the characteristic of the reverse signal RVS within one frame (such as a row inversion and a dot inversion), or the polarities of the data voltages simultaneously applied to the neighboring data lines may be different from each other.

Hereinafter, the data processing at the signal controller 600 according to an exemplary embodiment of the present invention will be explained with reference to FIGS. 3 to 6.

Figure 3:
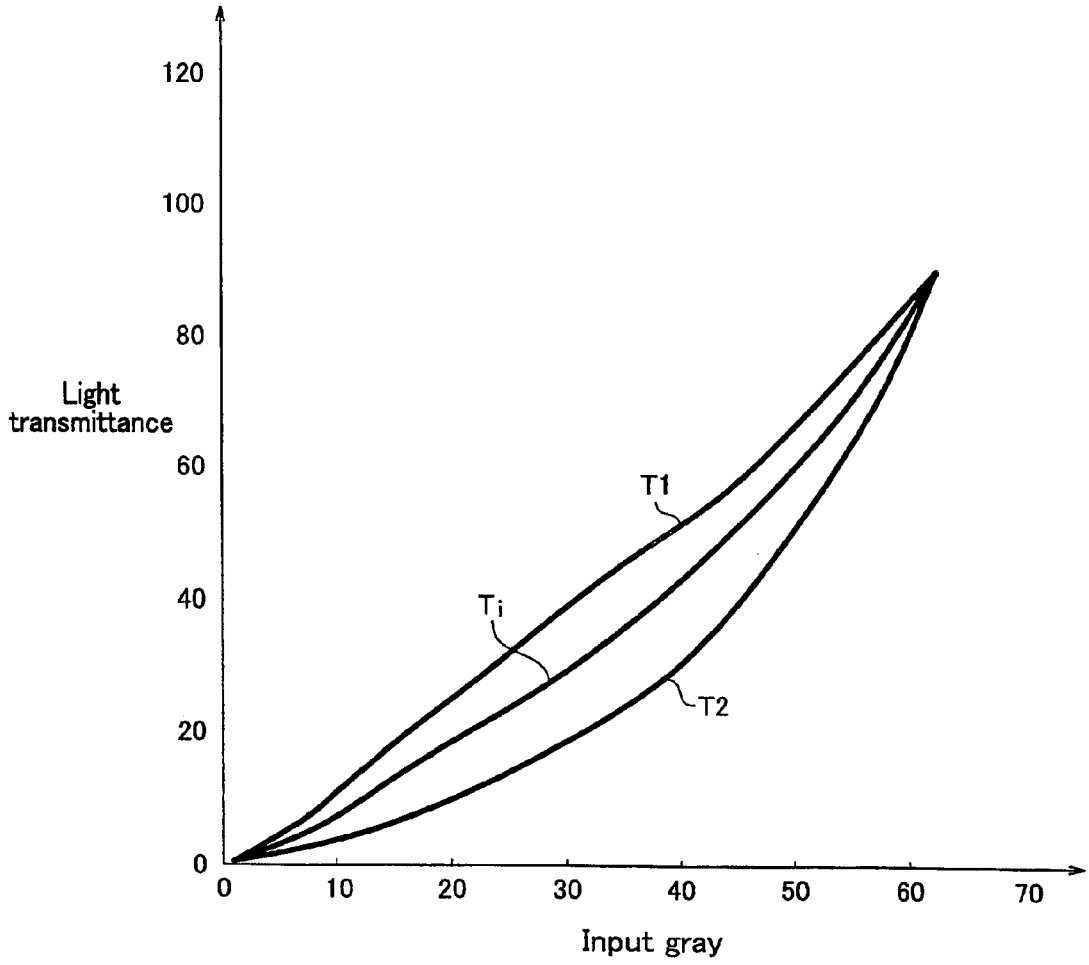
FIG. 3 is a graph of gamma curves before and after image data are corrected with an LCD having the signal controller shown in FIG. 1.

FIG. 3 is a graph illustrating gamma curves before and after image data are corrected with an LCD having the signal controller shown in FIG. 1. FIGS. 4A to 4D are diagrams showing output and inversion patterns of output image data according to an exemplary embodiment of the present invention. FIGS. 5A and 5B illustrate output image data corresponding to the input image data applied to an image data correction unit of a signal controller during the two neighboring frames according to an exemplary embodiment of the present invention. FIGS. 6A to 6D are diagrams showing inversion patterns of output image data according to an exemplary embodiment of the present invention.

In an exemplary embodiment of the present invention, the frame frequency is about 120 Hz, and the frequency of the signals output from the signal controller 600 is about 120 Hz. In an exemplary embodiment of the present invention, the frequency of the input image data R, G, and B is about 120 Hz, and the frequency of the output image data DAT is about 120 Hz. It is to be understood that the frequency value is not limited thereto.

As previously described with reference to FIG. 1, the signal controller 600 includes an image data correction unit 610. The image data correction unit 610 includes a signal processor 611, and a data storage unit 612 connected to the signal processor 611. The data storage unit 612 includes first and second data storage members 613 and 614.

The first and second data storage members 613 and 614 may be formed with a memory such as a ROM or a RAM, or a look-up table. It is to be understood that the first and second data storage members 613 and 614 may be formed with various kinds of memory elements.

The operation of the signal controller 600 will be described below.

The signal processor 611 of the signal controller 600 converts the respective input image data R, G, and B applied thereto into output image data a and b that is stored at the first or second data storage members 613 and 614 of the data storage unit 612, and outputs them. The input image data R, G, and B each having the relevant input gray values are converted into a plurality of output image data, for example two output image data a and b having different output gray values. The data conversion is performed considering the contrast ratio and other factors, and an example thereof will be explained with reference to FIG. 3.

As shown in FIG. 3, the mean value of the front gamma curves T1 and T2 represented by the two output image data a and b is established to correspond to the front gamma curve Ti with respect to the input image data R, G, and B before the correction. In addition, the mean value of the lateral side gamma curves represented by the two output image data a and b is most similar to the gamma curve Ti with respect to the input image data before the correction. In this case, the lateral side contrast ratio is enhanced.

A pair of output grays may comprise a lower gray lower than the input gray level and an upper gray level higher than the input gray level. In an exemplary embodiment of the present invention, the lower output image data a with the lower gray level are stored at the first data storage member 613, and the upper output image data b with the upper gray level are stored at the storage portion 614. Alternatively, the upper output image data b may be stored at the first data storage member 613, and the lower output image data a may be stored at the second data storage member 614.

In this way, the lower and upper output image data a and b with respect to the respective input grays are stored at the first and second data storage members 613 and 614, respectively.

Accordingly, the signal processor 611 selects one of the output image data stored at the first or second data storage members 613 and 614 based on the input grays of the input image data R, G, and B, and outputs the selected data as image data DAT. At this time, the first or second data storage member 613 or 614 is selected based on the frame number or the pixel row number, and the relevant output image data a and b are alternately output for the respective pixels.

Figure 4A:
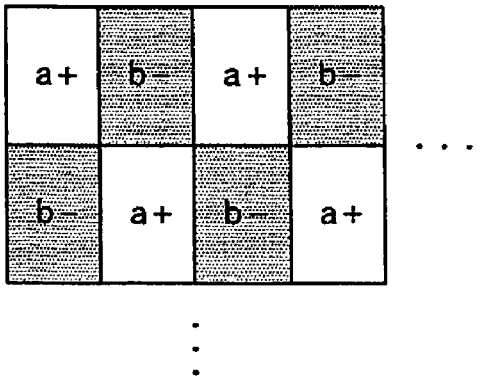
FIGS. 4A to 4D are diagrams illustrating output and inversion patterns of output image data according to an exemplary embodiment of the present invention.

As shown in FIG. 4A, with the first pixel row at the first frame, the output image data a stored at the first data storage member 613 are selected as the output image data corresponding to the first pixel, and the output image data b stored at the second data storage member 614 are selected as the output image data corresponding to the next pixel horizontally neighboring thereto. On the contrary, with the second pixel row, the output image data b stored at the second data storage member 614 are selected as the output image data corresponding to the first pixel, and the output image data a stored at the first data storage member 613 are selected as the output image data corresponding to the next pixel horizontally neighboring thereto. That is, the application order of the lower and the upper output image data a and b is repeated for the two pixel rows. With the odd-numbered pixel rows, the lower and upper output image data a and b stored at the first and second data storage members 613 and 614 are alternately applied, but with the even-numbered pixel rows, the upper and the lower output image data b and a stored at the second and first data storage members 614 and 613 are alternately applied.

Figure 4B:
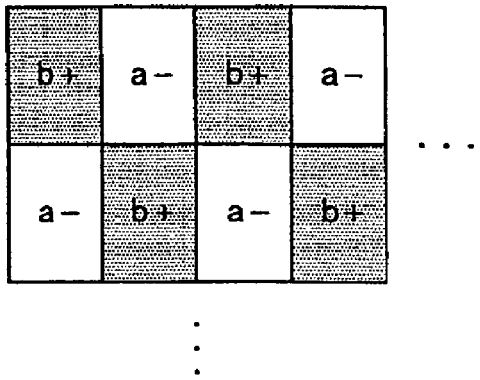
Figure 4C:
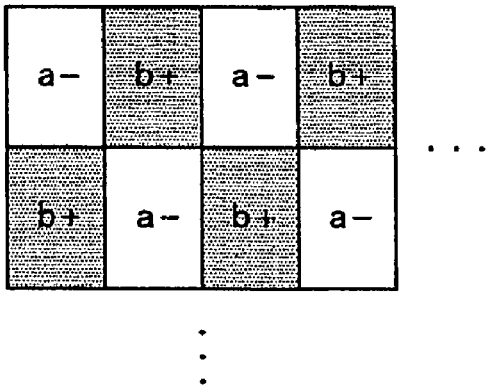
Figure 4D:
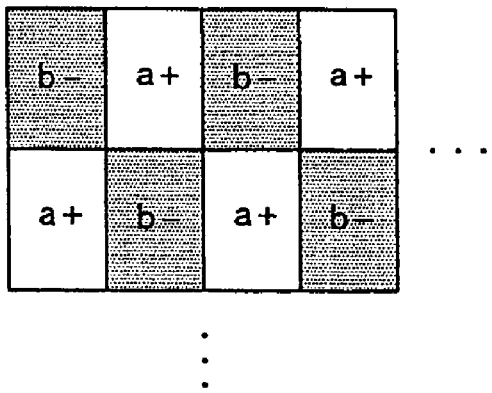

The data application order is converted per the respective frames. Accordingly, as shown in FIG. 4B, with the odd-numbered pixel rows at the second frame, the upper and the lower output image data b and a stored at the second and the first data storage members 614 and 613 are alternately applied, but with the even-numbered pixel rows, the lower and the upper output image data a and b stored at the first and second data storage members 613 and 614 are alternately applied.

In an exemplary embodiment of the present invention, the signal processor 611 may use horizontal synchronization signals Hsync to determine the order of pixel rows, or vertical synchronization signals Vsync to determine the order of frames, but it is not limited thereto. The signal processor 611 may use a separate counter or other control signals to determine the order of pixel rows and the order of frames.

Figure 5:
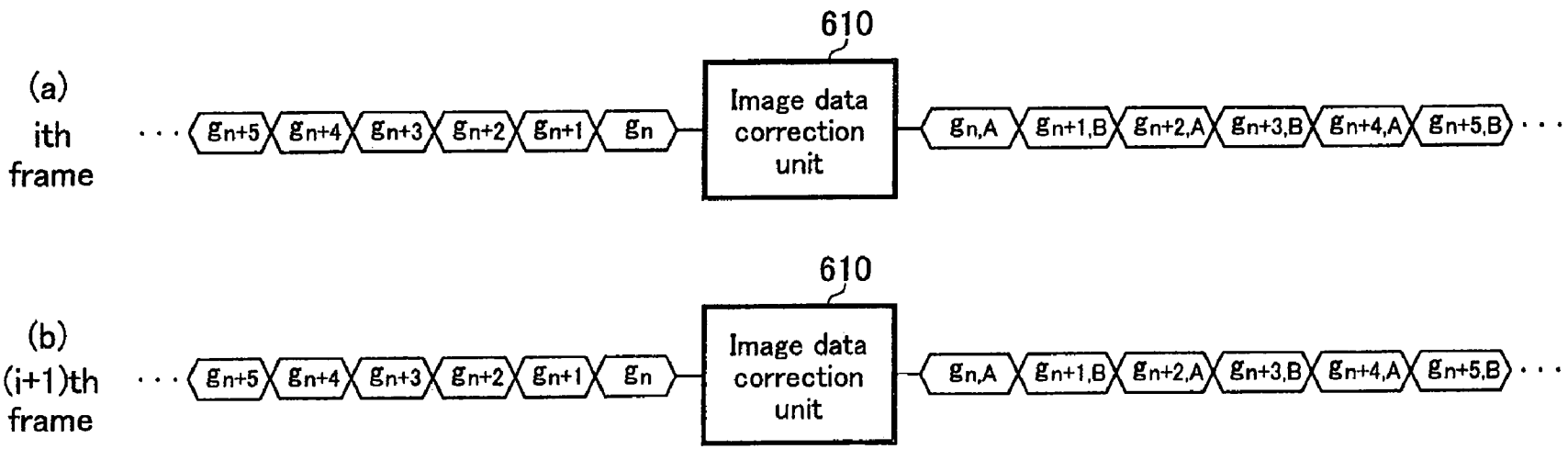
FIG. 5 is a diagram illustrating output image data corresponding to the input image data applied to an image data correction unit of a signal controller during the two neighboring frames according to an exemplary embodiment of the present invention.

Using the image data correction unit 610, as shown in FIG. 5, the output image data corresponding to the pixels at the neighboring frames become the output image data stored at the different data storage members 613 and 614, and the output image data corresponding to the neighboring pixels even at the same frame become the output image data stored at the different data storage members 613 and 614.

The application order of the output image data is not limited thereto. That is, with the first pixel row at the first frame, the upper output image data b stored at the second data storage member 614 may be applied to the first pixel, instead of the lower output image data a stored at the first data storage member 613.

The pattern of inversion when the output image data stored at the different data storage members 613 and 614 are applied to the respective pixel neighbors according to an embodiment of the present invention will be now described.

As explained earlier, the polarities of the data voltages shown in FIGS. 4A to 4D involve a 1×1 dot inversion pattern. Furthermore, as the mean value of the pixel voltages is not biased to either the "+" polarity or the "−" polarity only if the polarities of the data voltages corresponding to the two neighboring upper output image data are inverted and the polarities of the data voltages corresponding to the two neighboring lower output image data are inverted, the frame inversion has a two-frame inversion pattern. For example, the image data pattern and the polarity pattern shown in FIGS. 4A to 4D are repeated for four frames.

Figure 6A:
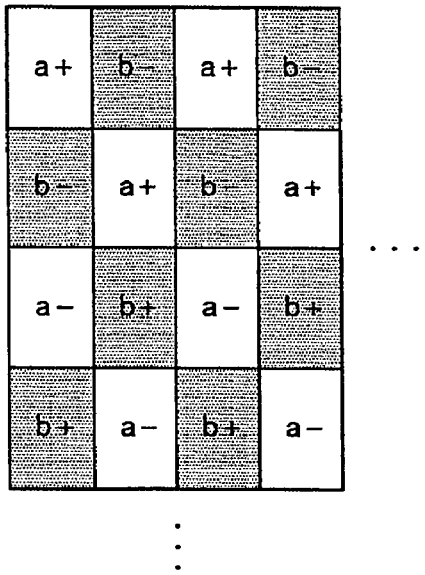
FIGS. 6A to 6D are diagrams illustrating inversion patterns of output image data according to an exemplary embodiment of the present invention.
Figure 6B:
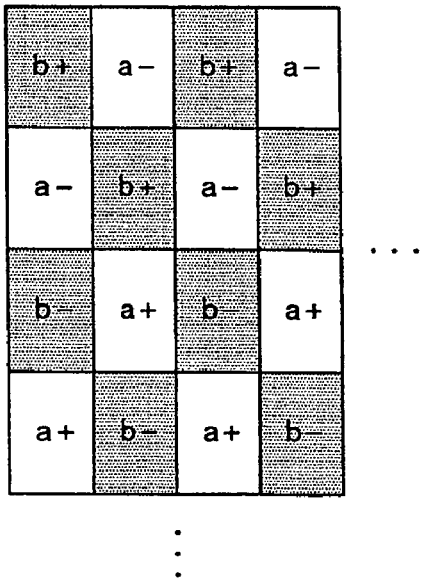
Figure 6C:
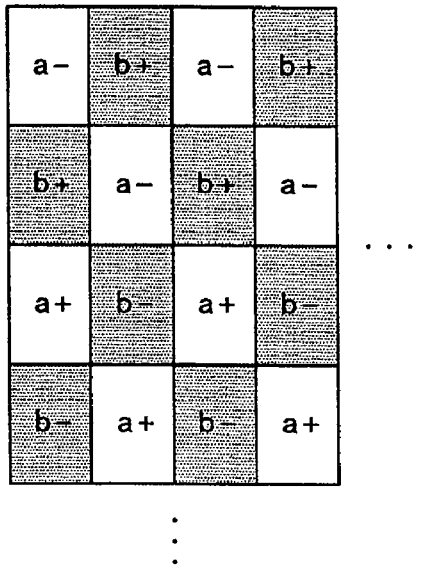
Figure 6D:
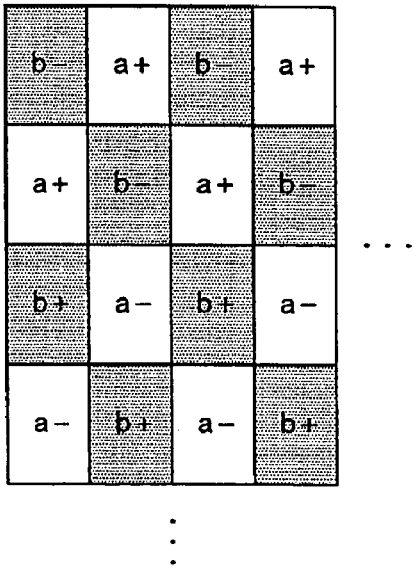

In contrast, the polarities of the data voltages shown in FIGS. 6A to 6*b* involve a (1×2)-dot inversion pattern and a two-frame inversion pattern. In this case, the image data pattern and the polarity pattern shown in FIGS. 6A to 6D are repeated for four frames. However, the polarity inversion is not limited to such a pattern, but may be another pattern of the dot inversion. It is to be understood that inversion patterns other than the dot inversion, for example, various patterns of row inversion or column inversion, should also be suitable for implementing the present invention.

Hereinafter, output patterns of output image data according to an exemplary embodiment of the present invention will be explained with reference to FIG. 7A to 7D.

FIGS. 7A to 7D are diagrams showing output patterns of output image data according to an exemplary embodiment of the present invention.

Figure 7A:
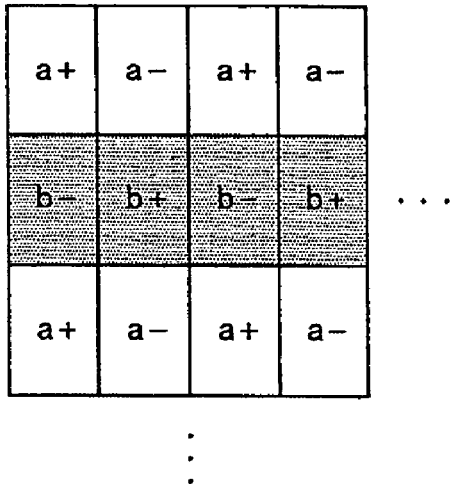
FIGS. 7A to 7D are diagrams illustrating output patterns of output image data according to an exemplary embodiment of the present invention.
Figure 7B:
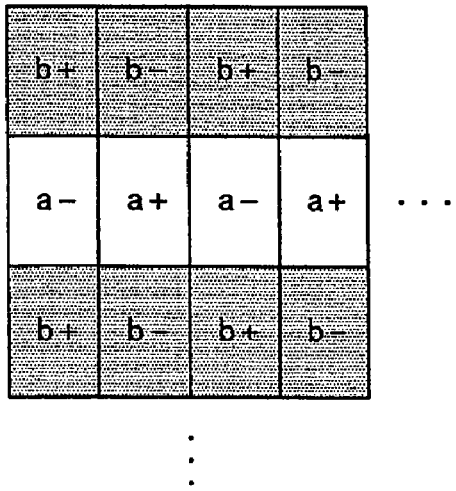
Figure 7C:
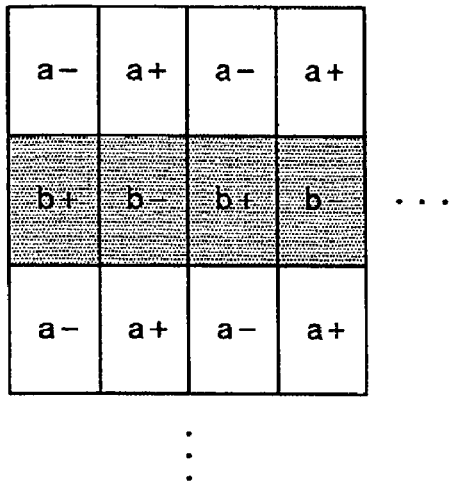
Figure 7D:
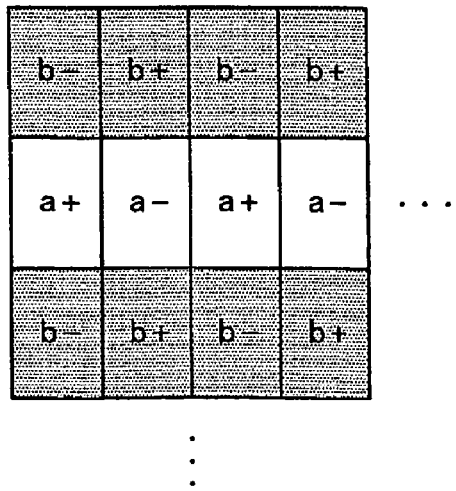

As shown in FIG. 7A, the lower and the upper output image data a and b stored at the same data storage member 613 and 614 are selected as the output image data corresponding to the pixels horizontally neighboring each other.

As shown in FIG. 7A, the lower output image data a stored at the first data storage member 613 are selected as the output image data corresponding to the odd-numbered pixel rows at the first frame, and the upper output image data b stored at the second data storage member 614 are selected as the output image data corresponding to the even-numbered pixel rows.

However, the data output pattern is varied for the respective frames. With the second frame, the upper output image data b with the upper output gray stored at the second data storage member 614 are selected as the output image data corresponding to the odd-numbered pixel rows, and the lower output image data a stored at the first data storage member 613 are selected as the output image data corresponding to the even-numbered pixel rows.

In an exemplary embodiment of the present invention, with the odd-numbered frames, the lower output image data a stored at the first data storage member 613 are selected as the output image data corresponding to the odd-numbered pixel rows, and the upper output image data b with the upper output gray stored at the second data storage member 614 are selected as the output image data corresponding to the even-numbered pixel rows. In contrast, with the even-numbered frames, the upper output image data b with the upper output gray stored at the second data storage member 614 are selected as the output image data corresponding to the odd-numbered pixel rows, and the lower output image data a stored at the first data storage member 613 are selected as the output image data corresponding to the even-numbered pixel rows.

However, the output pattern of the output image data is not limited thereto, but the output image data may alternatively be applied to the relevant pixels. With the odd-numbered frames, the upper output image data b with the upper output gray stored at the second data storage member 614 are selected as the output image data corresponding to the odd-numbered pixel rows, and the lower output image data a stored at the first data storage member 613 are selected as the output image data corresponding to the even-numbered pixel rows. Furthermore, with the even-numbered frames, the lower output image data a stored at the first data storage member 613 are selected as the output image data corresponding to the odd-numbered pixel rows, and the upper output image data b with the upper output gray memorized at the second data storage member 614 are selected as the output image data corresponding to the even-numbered pixel rows.

As explained above, the input gray value is converted into two output gray values, and the output image data with the lower and upper gray values that are stored at the first and second data storage members 613 and 614 are used as the output image data. However it will be understood that various configurations are suitable for implementing the present invention.

For example, unlike the gray voltage generator 800 shown in FIG. 1, a gray voltage generator according to an exemplary embodiment of the present invention includes a first gray voltage generating member for generating two sets of gray voltages corresponding to the output image data with the lower gray value, and a second gray voltage generating member for generating two sets of gray voltages corresponding to the output image data with the upper gray value. The first gray voltage generating member may generate gray voltages corresponding to the output image data with the upper gray value, and the second gray voltage generating member may generate gray voltages corresponding to the output image data with the lower gray value.

When the signal controller 600 processes the input image data R, G, and B into image data DAT depending upon the operation conditions of the liquid crystal panel assembly and applies them to the data driver 500, the data driver 500 selects the respective gray voltages among a plurality of gray voltages from the first gray voltage generating member and transmits them to the data lines D1-Dm as the data voltages when the pixel row is odd-numbered based on the orders of pixel rows. When the pixel row is even-numbered, the data driver 500 selects the relevant gray voltages from among a plurality of gray voltages from the second gray voltage generating member and transmits them to the data lines D1-Dm as the data voltages.

It is not required with the signal controller 600 to correct the input image data with the input gray value into the lower and the upper output image data with two output gray values.

The structure of the LCD for conducting the operation is the same as that shown in FIG. 1 except for the signal controller 600 and the gray voltage generator 800, and, hence, a detailed explanation thereof will be omitted in the interests of clarity.

As described above, when the lower (upper) output image data and the upper (lower) output image data are alternately applied for the respective pixel rows, as shown in FIGS. 7A to 7D, the polarities of the data voltages involve a (1×1)-dot inversion pattern and a two-frame inversion pattern.

Consequently, the image data pattern and the polarity pattern shown in FIGS. 7A to 7D are repeated for four frames.

However, the dot inversion is not limited to such a pattern, but may be another pattern of the dot inversion. It is to be understood that inversion patterns other than the dot inversion, for example, various patterns of row or column inversion should also be suitable for implementing the present invention.

As described above, the input image data having an input gray value are converted into two lower and upper output image data having lower and upper output gray values, and are applied to the pixels for the respective frames. In this case, as the input gray value is converted into a pair of lower and upper output gray values forming gamma curves similar to the front gamma curve based on the temporal mean light transmittance and attributed to the pixel, the deterioration in the display image quality due to the difference in contrast ratio between the front of the display and the its lateral sides may be reduced.

An LCD according to another exemplary embodiment of the present invention will be explained with reference to FIG. 8.

Figure 8:
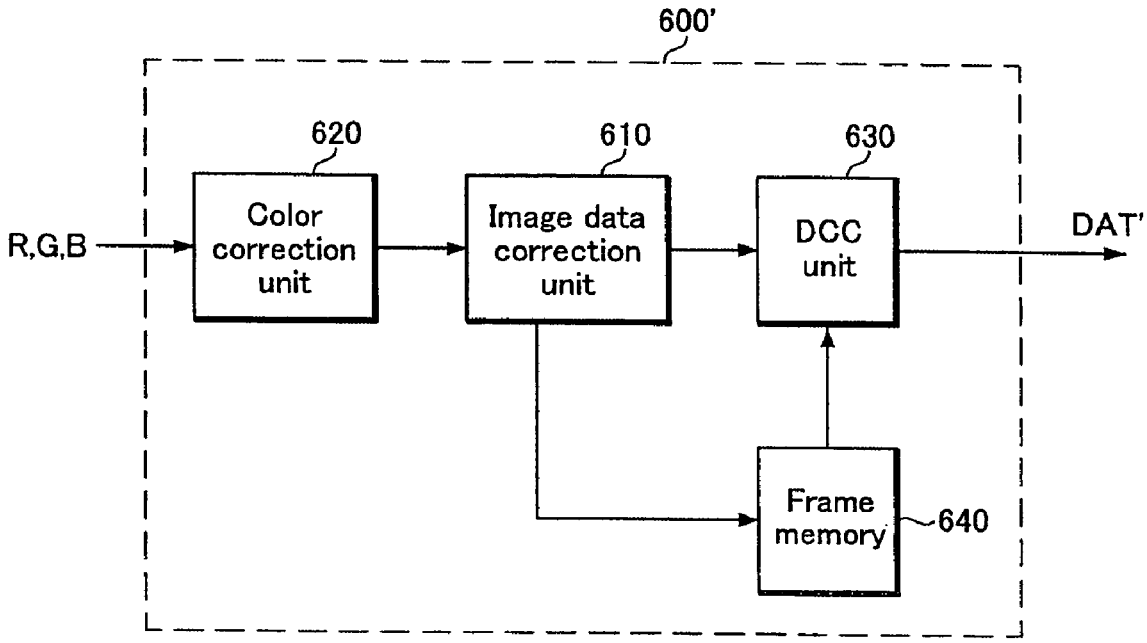
FIG. 8 is a block diagram of a signal controller of an LCD according to another exemplary embodiment of the present invention.

FIG. 8 is a block diagram of a signal controller of an LCD according to another exemplary embodiment of the present invention. The LCD of FIG. 8 has the same structure as the LCD shown in FIG. 1 except for a signal controller 600', and, hence, only the structure of the signal controller 600' will be explained in the interests of clarity.

As shown in FIG. 8, the signal controller 600' according to an exemplary embodiment of the present invention includes a color correction unit 620, an image data correction unit 610 connected to the color correction unit 620, a frame memory 640 connected to the image data correction unit 610, and a dynamic capacitance compensation unit (DCC) 630 connected to the image data correction unit 610 and the frame memory 640.

The operation of the signal controller 600' will be described below.

The structure of the image data correction unit 610 of the signal controller 600' is the same as that of the image data correction unit 610, and, hence, a detailed explanation thereof is omitted in the interests of clarity and simplicity.

First, the color correction unit 620 of the signal controller 600' corrects the input image signals R, G, and B from the outside such that the color temperature thereof has a predetermined characteristic depending upon the increase or decrease in the gray level, and transmits the corrected image signals to the image data correction unit 610.

As explained with reference to FIGS. 1 to 7, the image data correction unit 610 selects one of the output image data with a lower gray value and the output image data with an upper gray value based on the corrected input image signals R, G, and B, and applies the selected data to the DCC unit 630 and the frame memory 640.

The DCC unit 630 corrects the current output image data depending upon the magnitude of the difference between the current output image data from the image data correction unit 610 and the previous output image data stored at the frame memory 640.

For example, when the current output image data are greater than the previous output image data, the image data that are greater than the current output image data by a predetermined value, being the last output image data, are transmitted to the data driver 500 as data signals DAT'.

However, in the case that the current output image data are smaller than the previous output image data, the image data that are smaller than the current output image data by a predetermined value, being the last output image data, are transmitted to the data driver 500 as the data signals DAT'.

In the case that the current output image data are the same as the previous output image data, the current output image data, being the last output image data, are transmitted to the data driver 500 as the data signals DAT'.

As described above, in the case that the current output image data are different from the previous output image data, the current output image data are increased or decreased so that the pixels quickly approximate the target luminance, and the deterioration in the display image quality due to the delay in response time of the liquid crystal is reduced. Furthermore, as the color correction unit 620 corrects the input image data R, G, and B such that the color temperature thereof has a predetermined characteristic, the display image quality of the LCD may be enhanced.

With the structure according to an exemplary embodiment of the present invention, the input gray value is converted into a pair of lower and upper output gray values forming gamma curves similar to the front gamma curve based on the temporal mean light transmittance, and the converted gray values are alternately attributed to the pixels for the respective frames, so the deterioration in the display image quality due to the difference in contrast ratio between the front of the display and its lateral sides is reduced.

Furthermore, it is not necessary to divide a pixel into two sub-pixels so as to make the capacitance combination, so the aperture ratio of the display device is enhanced with suitable pixel light transmittance, thereby improving the display image quality.

The pixels speedily approximate the target luminance by conducting the DCC, so the deterioration in the display image quality due to the delay in response time of the liquid crystal is reduced. As the input image data are corrected by the color correction unit such that the color temperature thereof has a predetermined characteristic, the display image quality of the LCD may be enhanced.

Although the exemplary embodiments of the present invention have been described with reference to the accompanying drawings for the purpose of illustration, it is to be understood that the inventive processes and apparatus are not to be construed as limited thereby. It will be readily apparent to those of ordinary skill in the art that various modifications to the foregoing exemplary embodiments can be made without departing from the scope of the invention as defined by the appended claims, with equivalents of the claims to be included therein.

What is claimed is:

1. An apparatus for driving a display device having a plurality of pixels, the apparatus comprising:

a signal controller that receives an input image data and that outputs output image data; and a data driver for converting the output image data from the signal controller into data voltages and applying the data voltages to the pixels, wherein the signal controller comprises a color correction unit, an image data correction unit and a dynamic capacitance compensation unit, wherein the color correction unit corrects the input image data such that input image data color temperature has a predetermined characteristic depending upon an increase or decrease in the gray level, wherein the image data correction unit converts first output data from the color correction unit into first image data and second image data having a gray level lower than a gray level of the first image data, wherein the dynamic capacitance compensation unit corrects second output data from the image data correction unit depending upon a magnitude of a difference between second output data of a present frame and second output data of a previous frame, and wherein the mean value of front gammas of the first image data and the second image data corresponds to a front gamma with respect to the input image data.

2. The apparatus of claim 1, wherein the first image data and the second image data are alternately applied to the respective pixels.

3. The apparatus of claim 2, wherein the polarities of the data voltages applied to the plurality of pixels are based on a (1×2)-dot inversion.

4. The apparatus of claim 2, wherein the first image data and the second image data are alternately applied to predetermined pixels per a frame.

5. The apparatus of claim 2, wherein the polarities of the data voltages applied to the plurality of pixels are based on a (1×1)-dot inversion.

6. The apparatus of claim 1, wherein the first image data and the second image data are alternately applied to the respective pixel rows.

7. The apparatus of claim 1, wherein the signal controller comprises a first data storage member for storing the first image data and a second data storage member for storing the second image data.

8. The apparatus of claim 1, wherein the signal controller further comprises a frame memory for storing the second output data of the previous frame.

9. The apparatus of claim 1 wherein the input image data has a frequency of about 120 Hz.

10. The liquid crystal display device of claim 1, wherein the polarities of the data voltages applied to the plurality of pixel are based upon a two-frame inversion.

11. An apparatus for driving a display device having a plurality of pixels, the apparatus comprising:

a signal controller for converting input image data into output image data and outputting the output image data;

a gray voltage generator comprising a first gray voltage generating member for generating a plurality of first gray voltages and a second gray voltage generating member for generating a plurality of second gray voltages; and a data driver for selecting one of the first or second gray voltage generating members based on the output image data from the signal controller, converting the respective gray voltages into data voltages and applying the converted voltages to the pixels, wherein the signal controller comprises a color correction unit, an image data correction unit and a dynamic capacitance compensation unit, wherein the color correction unit corrects the input image data such that input image data color temperature has a predetermined characteristic depending upon an increase or decrease in gray level;

wherein the image data correction unit converts first output data from the color correction unit into first image data and second image data having a gray level lower than a gray level of the first image data, wherein the dynamic capacitance compensation unit corrects second output data from the image data correction unit depending upon a magnitude of a difference between second output data of a present frame and second output data of a previous frame, wherein the first gray voltages correspond to the first image data and the second gray voltages correspond to the second image data, and wherein the mean value of front gammas of the image data corresponding to the first and second gray voltages corresponds to a front gamma with respect to the input image data.

12. The apparatus of claim 11 wherein the first and second gray voltages are alternately applied per the respective pixel rows.

13. The apparatus of claim 12 wherein the first and second gray voltages are alternately applied to predetermined pixels per frame.

14. The apparatus of claim 12 wherein the polarities of the gray voltages applied to the plurality of pixels are based on a (1×1)-dot inversion.

15. The apparatus of claim 11 wherein the input image data have a frequency of about 120 Hz.

16. The liquid crystal display device of claim 11, wherein the polarities of the gray voltages applied to the plurality of pixels are based upon a two-frame inversion.

* * * * *